United States Patent [19]

Greenwood

[11] Patent Number: 4,872,783

[45] Date of Patent: Oct. 10, 1989

[54] BALANCED BUOYANCY CONTROL DIVING GEAR

[76] Inventor: Alden T. Greenwood, R.F.D. Box 213, Greenville Rd., Mason, N.H. 03048

[21] Appl. No.: 207,236

[22] Filed: Jun. 16, 1988

[51] Int. Cl.[4] ..... B63C 11/08

[52] U.S. Cl. ..... 405/186; 441/108

[58] Field of Search ..... 465/185, 186, 187; 441/92, 96, 106, 108, 111–119; 128/202.14

[56] References Cited

U.S. PATENT DOCUMENTS

| | | | |
|---|---|---|---|
| 65,760 | 6/1867 | McKeen | 405/187 |
| 2,303,155 | 11/1942 | Berge | 128/202.14 |
| 2,483,116 | 9/1949 | Yarbrough | 128/202.14 |
| 2,535,874 | 12/1950 | Starn | 9/342 |
| 2,842,785 | 7/1958 | Sieverts | 9/316 |
| 2,936,755 | 5/1960 | Gasser | 9/316 |
| 2,982,105 | 5/1961 | Akers | 9/316 X |
| 2,989,971 | 6/1961 | Valentine | 137/102 |
| 3,070,112 | 12/1962 | Fricke | 137/102 |
| 3,147,499 | 9/1964 | Nelson | 9/313 |
| 3,161,028 | 12/1964 | Odum et al. | 405/186 |
| 3,192,723 | 7/1965 | Apperson | 61/70 |
| 3,204,260 | 9/1965 | Fitzmaurice | 11/345 X |
| 3,695,048 | 10/1972 | Dimick | 405/186 |
| 3,898,705 | 8/1975 | Schuler | 405/186 |
| 4,000,534 | 1/1977 | Cerniway et al. | 405/186 |

FOREIGN PATENT DOCUMENTS 352392 6/1931 United Kingdom .

*Primary Examiner*—David H. Corbin

*Attorney, Agent, or Firm*—Kenway & Crowley

[57] ABSTRACT

Diver's gear including a unit having front and rear panels and at least one built-in dual bladder or cell assembly which includes a cell within a cell. The diver's gear also includes a back rack to carry a tank of compressed breathing gas and at least one vacuum tank. A suitable arrangement of hoses and valves is connected to the tank of breathing gas and to the outer of the two bladder cells. Another hose and valve assembly is connected from the vacuum tank for deflation of the inner of two bladder cells. The valves may be manipulated to apply pressure and vacuum in suitable combinations to the specially constructed bladder or cell assembly to provide balanced and precisely controlled buoyancy for the diver.

7 Claims, 2 Drawing Sheets

BALANCED BUOYANCY CONTROL DIVING GEAR

BACKGROUND OF THE INVENTION

Control of buoyancy in presently available divers jackets is achieved by utilizing compressed breathing gas contained in a tank carried on the best or jacket. Usually, air cells or bladders are incorporated in the jacket and may be inflated relatively easily by opening a valve to permit the inflow of breathing gas. On the other hand, deflation is awkward for the diver, for he must assume an upright position and hold an outlet hose attached to the bladder above his head with the deflation valve open to allow water pressure to force gas out of the bladder into the surrounding ocean. It would be desirable, of course, for the diver to be able to inflate or deflate the jacket no matter what his position, preferably by the manipulation of simple control valves. The diver's control of his buoyancy would thus be greatly simplified. Also, the more compact device made possible would decrease bulk and lessen water drag encountered by the diver while swimming. Finally, a precise control or trimming of buoyancy would be most useful to the diver.

SUMMARY OF THE INVENTION

This invention involves basically a system for combined inflation and vacuum-assisted deflation of a divers jacket for balanced buoyancy control regardless of the diver's position in the water.

An assembly of one or more cells within cells is used in constructing the jacket to keep the gas where it will maximize stability as the diver changes positions in the water. At the same time, the cells are so located and interconnected that inflation and deflation can be accomplished easily and efficiently whatever the diver's position or attitude relative to the vertical may be in the water. A simple valve assembly controls the inflow of inflating gas from the diver's tank to an outer cell and the outflow of gas from an inner cell to a vacuum tank to deflate the jacket. The construction and location of the jacket and cells is also such as to insulate the diver from his cold water environment.

BRIEF DESCRIPTION OF DRAWINGS

For a better understanding of the invention, reference should be had to the accompanying drawings, forming a part of this specification, in which.

DESCRIPTION OF THE PREFERRED EMBODIMENT

Figure 1:
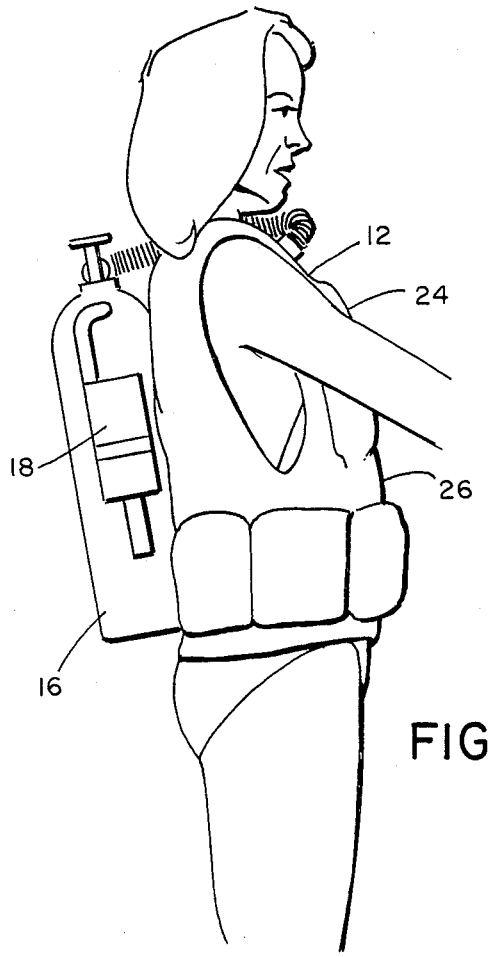
FIG. 1 is a side view of a diver with a jacket and back rack showing pressure and vacuum cells and pressure and vacuum tanks.

Referring to FIG. 1, there may be seen a diver wearing diving gear in the form of a diver's jacket 12. Any type of gear such as a jacket, a vest, or the so-called "horse-collar" design may be used, but generally there is an opening for the diver's head and straps to secure it about his trunk or shoulders. Straps and fasteners as needed may be used to maintain the unit in place depending upon its design and configuration.

A back rack 14 which may be fixed to the diver's torso supports a tank of breathing gas 16 and a vacuum tank 18. Within the jacket 12 there are mounted dual bladder or cell assemblies, each of which is actually a cell-within-a-cell. Typical outer cells 24 and 26 constructed of a thin-walled, gas-tight, flexible material are mounted behind the front panel of the jacket and may be held in place in pockets formed on the inner wall. Similar cells-within-cells may be mounted in the rear panel of the jacket. The size and shape of the cells may be varied as necessary to conform to the jacket, but they are preferably disposed to lie adjacent the trunk of the diver. The cells are connected together by a system of hoses. to allow free passage of gas from the tank 16 mounted on the back rack worn by the diver to the outer cells of each paired assembly.

Figure 2:
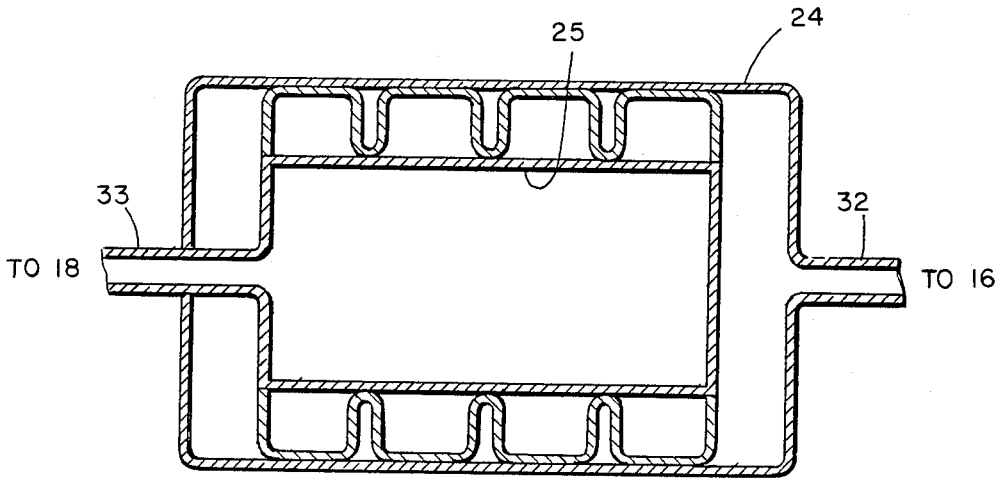
FIG. 2 is a schematic view of a typical combination of outer and vacuum cells and connecting hoses.

In FIG. 2, there is shown a typical cell-within-a-cell. The outer or pressure cell 24 is sealed to a main gas line 32 which leads to the pressure tank 16. An inner cell 25 is sealed to a main vacuum line 33 which leads to a vacuum tank 18. The inner wall of the outer cell 24 is tacked or welded at spaced points to the outer wall of the inner cell 25. As noted above, all cells are constructed of gas-tight flexible material, and the vacuum line 33 is sealed through the wall of the outer cell 24 to communicate with the interior of the inner cell 25. Conversely, the pressure or gas line 32 is sealed to the outer cell 24 and provides communication between that cell and the tank of breathing gas 16. As has been noted in connection with FIG. 1, there are a number of such cell-within-cell assemblies disposed throughout the divers jacket. Each pressure or outer cell is in communication with all other pressure cells, and each vacuum or inner cell is in communication with all other vacuum or inner cells.

Figure 3:
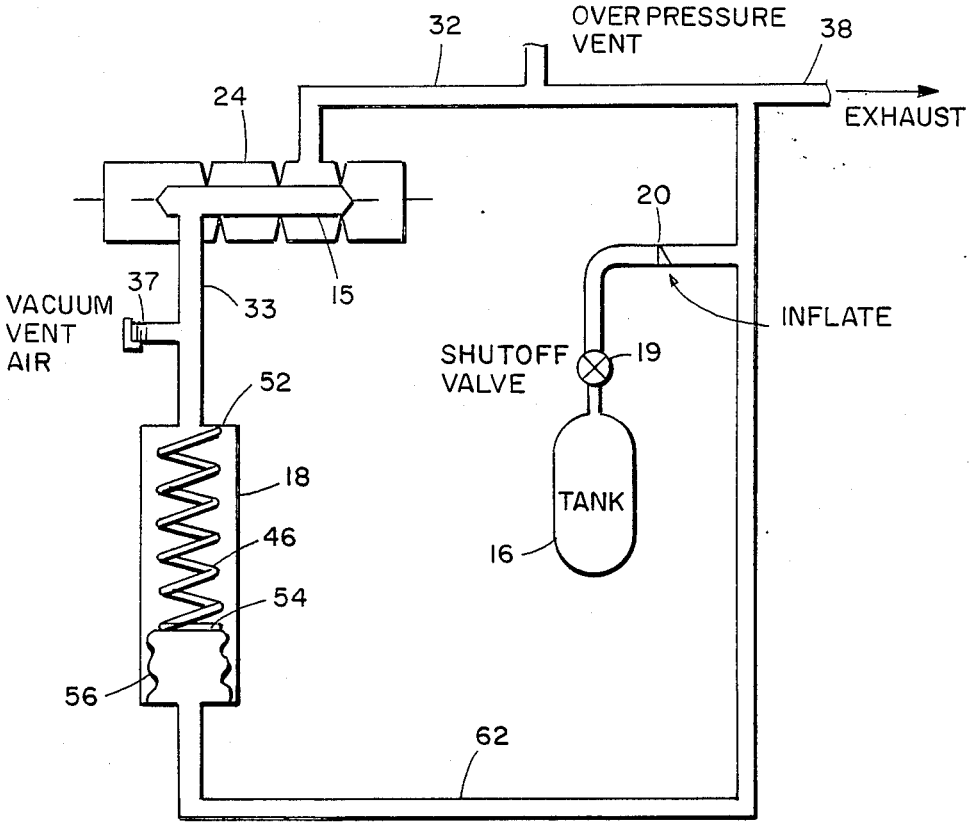
FIG. 3 is a schematic showing of a typical system of tanks, cells, and valves.

In FIG. 3, a schematic showing of one embodiment of the buoyancy system is shown. The tank of breathing gas 16 has a shut-off valve 19 and a fill valve 20 interposed in the main gas line 32 which leads to the outer or pressure cell 24. In the line 32 there may also be included an overpressure safety valve 35 for purposes explained in greater detail hereinbelow. On a Tee leading off the line 32, there is also an exhaust valve 38 leading to the outside environment.

The inner cell 25 is connected by way of the line 33 to the vacuum tank 18. A vent 37 leading off the line 33 is provided for purposes also explained hereinbelow. Within the vacuum tank 18 is a coiled spring 46 compressed between an end cover 52 of the vacuum tank 18 and a plate 54 mounted on a rolling diaphragm 56. The rolling diaphragm divides the tank 18 into two compartments. Other dividers such as pistons or similar movable members could be used. From the bottom of the vacuum tank 18 a line 62 extends back to and joins the main fill line 32.

Figure 4:
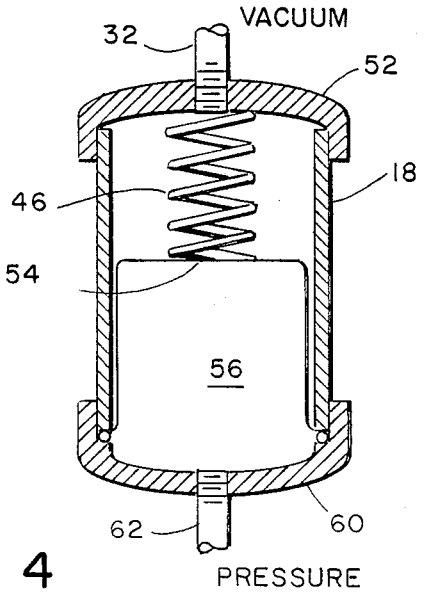
FIG. 4 is a cross-section of a vacuum tank incorporating a mechanical actuating system.

In FIG. 4, the vacuum tank 18 is shown in greater detail. It will be seen that the cover 52 is tightly sealed to the walls of the tank 18 and the coiled spring 46 is compressed between the cover 52 and the plate 54 on the rolling diaphragm 56. The bottom cover 60 of the vacuum tank 18 extends over the base of the rolling diaphragm 56 and that base forms a seal between the bottom cover 60 and the wall of the vacuum tank 18. The line 62 is shown as passing through the bottom cover 60.

The vent 37 may typically be of the screw-type and may be opened by the diver before entering the water. By compressing the cells or by sucking air from the vent, an initial collapsed condition of the inner cells is set up and the communicating portion of the vacuum tank is substantially emptied of gas.

In operation of the buoyancy system, the diver opens the valve 20 to permit breathing gas to flow from the tank 16 through the line 32 to the pressure cells 24. The line 32 is also in communication with the line 62 as shown in FIG. 3. The pressure cells become inflated, the diver's jacket increases in volume, and buoyancy increases. Also, pressure in the line 62 compresses the spring 46. When the diver achieves neutral buoyancy at the level he desires to remain at, he closes or discontinues holding open the inflate valve 20. Should he then begin an ascent, the overpressure valve 35 automatically opens, allowing gas to escape directly from the pressure cells and avoid undesired over-pressure conditions.

If the diver wishes to descend, he merely opens the exhaust valve 38. Opening the exhaust valve 38 relieves the pressure against the rolling diaphragm plate 54 which is then forced downwardly by the spring 46. As the plate 54 descends, it enlarges the compartment formed above the diaphragm 56 and pulls a vacuum in the upper portion of the tank 18. The negative pressure so generated draws residual air from the vacuum cells through the line 33 into the tank 18.

The inner vacuum cells collapse, carrying with them the walls of the outer pressure cells. Thus, positive sea pressure on the outer cells plus the generated negative pressure in the inner cells forces residual gas from the pressure cells through the exhaust valve 38 into the surrounding ocean.

Although the total negative pressure generated in the vacuum tank is of relatively slight magnitude, it is sufficient to assure the collapse of the cells when it is added to the sea pressure about the outer cells. More important, it is sufficient that the diver need not adopt any special attitude or position in the water to reduce his buoyancy to an extremely low value. As a result, maneuverability and freedom of action are greatly enhanced and buoyancy may be controlled to a more precise degree than can be had with systems lacking vacuum action.

What is claimed is:

1. A buoyancy control system for diver's gear comprising at least an inflatable outer cell having a flexible wall mounted in said gear, means for inflating said outer cell to increase the volume thereof, a deflatable inner cell also having a flexible wall disposed within said outer cell, means for deflating said inner cell and means connecting said flexible wall of said inner cell to said flexible wall of said outer cell at spaced points for common movement thereof whereby deflating of said inner cell reduces the volume of said outer cell and the buoyancy of said diver's gear.

2. A system as defined in claim 1 wherein said means for deflating said inner cell comprises an empty tank connected to said inner cell and means for creating a vacuum in said empty tank.

3. A system as defined in claim 2 wherein said means for creating a vacuum in said tank comprises a diaphragm forming a compartment within said tank and means for moving said diaphragm to remove air from said inner cell to said compartment.

4. A system as defined in claim 3 and further including a spring normally urging said diaphragm in a direction tending to enlarge said compartment.

5. A system as defined in claim 4 wherein said means for inflating said outer cell comprises a tank of compressed gas and a first line connecting said tank of compressed gas to said inflating means and a second line connected between said tank of compressed gas and said vacuum tank to actuate said means for creating a vacuum in said empty tank.

6. A system as defined in claim 5 wherein said second line is connected to said vacuum tank at a point on the opposite side of said diaphragm from said spring whereby gas flowing from said tank of breathing gas through said second line tends to reduce the size of said compartment and compress said spring.

7. A method for controlling the buoyancy of diver's gear comprising the steps of assembling in said gear two flexible-walled cells one within the other, the walls of the inner cell being attached at spaced points for common movement thereof to the walls of the outer cell, increasing buoyancy of said gear by inflating said outer cell with gas and decreasing buoyancy by releasing gas from said outer cell and evacuating gas from said inner cell.

* * * * *